US009429107B2

(12) United States Patent
Groh et al.

(10) Patent No.: US 9,429,107 B2
(45) Date of Patent: Aug. 30, 2016

(54) SOLENOID AUTOCHOKE FOR AN ENGINE

(71) Applicant: Briggs & Stratton Corporation, Wauwatosa, WI (US)

(72) Inventors: Casey E. Groh, Shorewood, WI (US); Adam J. Hellman, Bayside, WI (US); Timothy J. Kwiatkowski, Muskego, WI (US); Andrew J. Perez, Brookfield, WI (US); Jeff J. Steenbergen, Watertown, WI (US); Michael R. Visuri, Brown Deer, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 640 days.

(21) Appl. No.: 13/774,236

(22) Filed: Feb. 22, 2013

(65) Prior Publication Data

US 2014/0238343 A1 Aug. 28, 2014

(51) Int. Cl.

| | |
|---|---|
| ***F02M 1/02*** | (2006.01) |
| ***F02N 19/00*** | (2010.01) |
| *F02N 11/08* | (2006.01) |
| *F02M 1/08* | (2006.01) |
| *F02M 35/10* | (2006.01) |
| *F02D 9/10* | (2006.01) |
| *F02D 9/02* | (2006.01) |

(52) U.S. Cl.

CPC ..... *F02M 1/02* (2013.01); *F02N 19/00* (2013.01); *F02D 9/1065* (2013.01); *F02D 2009/0205* (2013.01); *F02M 1/08* (2013.01); *F02M 35/1017* (2013.01); *F02N 11/087* (2013.01); *F02N 2019/002* (2013.01)

(58) Field of Classification Search

CPC ..... F02M 1/02; F02M 1/08; F02N 19/00; F02N 19/01; F02N 2019/002; F02N 19/001; F02D 9/1065; F02D 41/067; F02D 2009/0205

USPC ..... 123/400, 179.18; 261/64.6

See application file for complete search history.

(56) References Cited

U.S. PATENT DOCUMENTS

| | | | | |
|---|---|---|---|---|
| 1,139,851 | A | 5/1915 | Dayton | |
| 1,334,555 | A | 3/1920 | Robbins et al. | |
| 1,851,711 | A | 3/1932 | Linga | |
| RE18,731 | E | 2/1933 | Weatherhead, Jr. | |
| 2,017,239 | A | 10/1935 | Gerald | |
| 2,127,653 | A * | 8/1938 | Sisson | 123/179.16 |

(Continued)

FOREIGN PATENT DOCUMENTS

GB 0 186 716 10/1922

OTHER PUBLICATIONS

U.S. Appl. No. 13/371,051, filed Feb. 10, 2012, Visuri.

*Primary Examiner* — Lindsay Low
*Assistant Examiner* — Robert Werner
(74) *Attorney, Agent, or Firm* — Foley & Lardner LLP

(57) ABSTRACT

A choke system for an internal combustion engine includes a carburetor having an air intake, a choke valve disposed in the air intake, and a choke lever coupled to the choke valve, wherein the choke valve is movable between a closed position and an open position, a mechanical linkage coupled to the choke lever, and a solenoid attached to the carburetor and coupled to the mechanical linkage so activation of the solenoid moves the choke valve, wherein the solenoid is activated in response to activation of a starter system of an internal combustion engine, thereby moving the choke valve via the mechanical linkage to the closed position.

18 Claims, 7 Drawing Sheets

(56) References Cited

U.S. PATENT DOCUMENTS

| | | | | | |
|---|---|---|---|---|---|
| 2,548,334 | A | | 4/1951 | Armstrong | |
| 2,764,393 | A | * | 9/1956 | Geyer | 261/64.6 |
| 2,783,984 | A | | 3/1957 | Kramer | |
| 2,908,263 | A | | 10/1959 | Brown | |
| 2,935,977 | A | | 5/1960 | Eberline | |
| 2,979,047 | A | | 4/1961 | Rapplean et al. | |
| 3,064,953 | A | | 11/1962 | Hayes | |
| 3,118,433 | A | | 1/1964 | Lechtenberg | |
| 3,161,186 | A | | 12/1964 | Reichenbach et al. | |
| 3,194,224 | A | | 7/1965 | Lechtenberg et al. | |
| 3,199,530 | A | | 8/1965 | Svendsen | |
| 3,305,223 | A | | 2/1967 | Reichenbach | |
| 3,534,720 | A | * | 10/1970 | Chester | 261/39.1 |
| 3,823,700 | A | | 7/1974 | Gumtow | |
| 3,863,614 | A | | 2/1975 | Thompson et al. | |
| 4,031,872 | A | | 6/1977 | Thompson et al. | |
| 4,068,636 | A | | 1/1978 | Nau et al. | |
| 4,151,499 | A | | 4/1979 | Ganowsky et al. | |
| 4,254,064 | A | | 3/1981 | Bernauer et al. | |
| 4,788,014 | A | | 11/1988 | Kanno | |
| 4,860,608 | A | | 8/1989 | Kobayashi | |
| 5,537,964 | A | * | 7/1996 | Hoshiba | 123/179.18 |
| 5,827,455 | A | | 10/1998 | Nakai | |
| 5,832,888 | A | * | 11/1998 | Griffiths et al. | 123/179.18 |
| 6,114,941 | A | | 9/2000 | Scott | |
| 6,116,581 | A | | 9/2000 | Watanabe et al. | |
| 6,202,989 | B1 | | 3/2001 | Pattullo | |
| 6,752,110 | B2 | * | 6/2004 | Tharman et al. | 123/179.18 |
| 6,990,969 | B2 | | 1/2006 | Roth et al. | |
| 7,331,326 | B2 | | 2/2008 | Arai et al. | |
| 7,344,125 | B2 | | 3/2008 | Matsuda et al. | |
| 7,628,387 | B1 | | 12/2009 | Clouse et al. | |
| 8,754,556 | B2 | * | 6/2014 | Haruno et al. | 310/71 |
| 8,783,664 | B2 | * | 7/2014 | Arai | 261/38 |
| 2005/0144919 | A1 | | 7/2005 | Osborne | |
| 2006/0283968 | A1 | | 12/2006 | Reichle | |
| 2009/0146327 | A1 | | 6/2009 | Roth | |
| 2009/0293828 | A1 | | 12/2009 | Iwata et al. | |
| 2009/0299614 | A1 | | 12/2009 | Iwata et al. | |
| 2011/0226217 | A1 | | 9/2011 | Raasch | |

* cited by examiner

SOLENOID AUTOCHOKE FOR AN ENGINE

BACKGROUND

The present invention relates to an engine starting system for an internal combustion engine. More particularly, the invention relates to an automatic choke system for a small engine.

Internal combustion engines typically include a system or mechanism, such as a carburetor with a choke valve, to regulate the air/fuel mixture to the engine. The choke valve reduces the airflow through the carburetor to enrich the air/fuel mixture. When starting the engine, it is typically desirable to provide a rich air/fuel mixture. When initially starting an engine in cold engine temperature conditions, it may be desirable to keep the choke closed for an extended period of time.

SUMMARY

One embodiment of the invention relates to a choke system for an internal combustion engine including a carburetor having an air intake, a choke valve disposed in the air intake, and a choke lever coupled to the choke valve, wherein the choke valve is movable between a closed position and an open position, a mechanical linkage coupled to the choke lever, and a solenoid attached to the carburetor and coupled to the mechanical linkage so activation of the solenoid moves the choke valve, wherein the solenoid is activated in response to activation of a starter system of an internal combustion engine, thereby moving the choke valve via the mechanical linkage to the closed position.

Another embodiment of the invention relates to an engine starting system including a battery, a starter motor electrically coupled to the battery, a starter switch electrically coupled between the battery and the starter motor, an ignition actuator configured to close the starter switch when the ignition actuator is in a start position, a carburetor having an air intake and a choke valve disposed in the air intake, and an automatic choke mechanism coupled to the choke valve, the automatic choke mechanism comprising a solenoid electrically coupled to the starter switch and mechanically coupled to the choke valve, wherein the solenoid includes a plunger moveable in a direction parallel to a flow of air through the air intake between an extended position and a refracted position, and wherein the plunger moves to the retracted position to close the choke valve when the starter switch is closed and moves to the extended position to open the choke valve when the starter switch is open.

Another embodiment of the invention relates to a method for adjusting the position of a choke valve including providing a choke valve in the air passage of a carburetor, providing a linkage external to the carburetor and coupled to the choke valve, providing an automatic choke mechanism electrically coupled to a starting system for an engine, the automatic choke mechanism comprising a solenoid coupled to the linkage and oriented parallel to the air passage, and energizing the solenoid upon activation of the starting system, thereby rotating the linkage and closing the choke valve.

BRIEF DESCRIPTION OF THE DRAWINGS

The disclosure will become more fully understood from the following detailed description, taken in conjunction with the accompanying figures.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Figure 1:
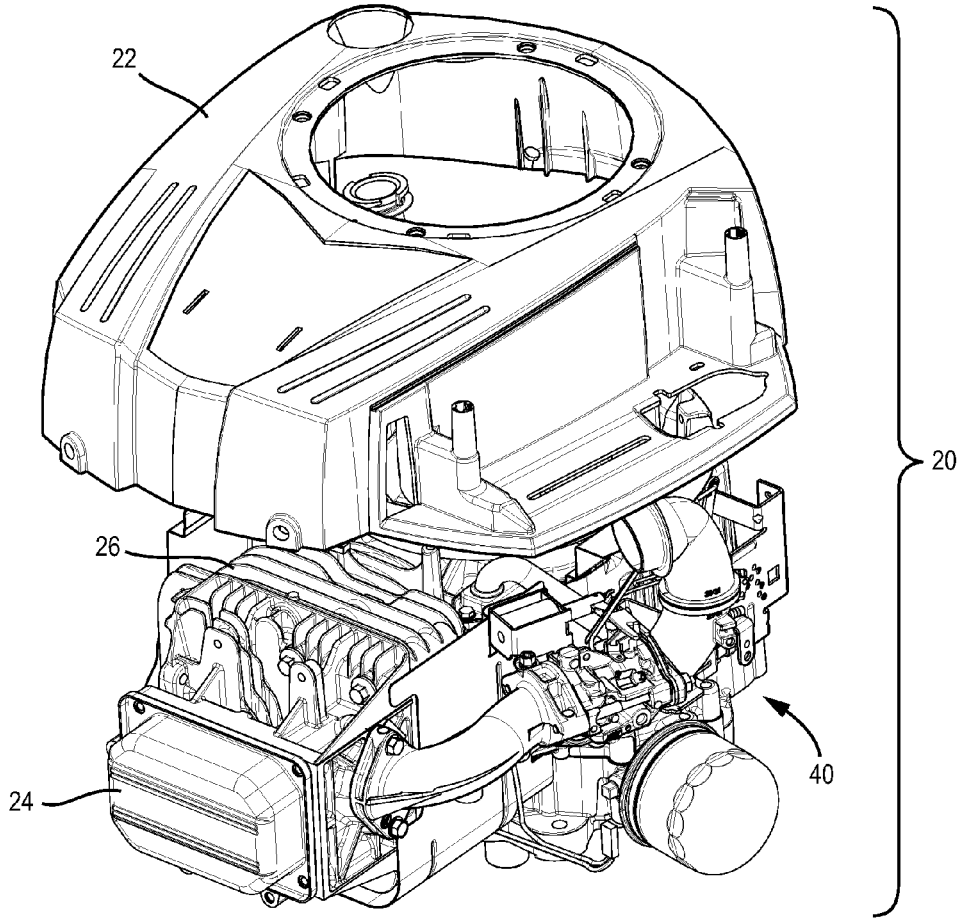
FIG. 1 is an exploded view of an internal combustion engine including a choke override, in accordance with an exemplary embodiment.

Referring to FIG. 1, in an exemplary embodiment, an engine 20 is a small, single cylinder, gasoline-powered, four-stroke cycle internal combustion engine. However a broad range of engines may benefit from the teachings disclosed herein. In some embodiments, the engine 20 is vertically shafted (as shown in FIG. 1), while in other embodiments, the engine may be horizontally shafted. In some contemplated embodiments, the engine may include two or more cylinders or may have a two-stroke cycle. In one embodiment, the engine is configured to power a riding lawn mower. In other embodiments, the engine 20 may be configured to power a broad range of equipment, including walk behind lawn mowers, pressure washers, electric generators, snow throwers, and other outdoor power equipment. In contemplated embodiments, the engine 20 may be gasoline-powered or otherwise fueled. The engine 20 includes a cover 22 and a cylinder head 24 that are fastened to an cylinder block 26 of the engine 20.

Figure 2:
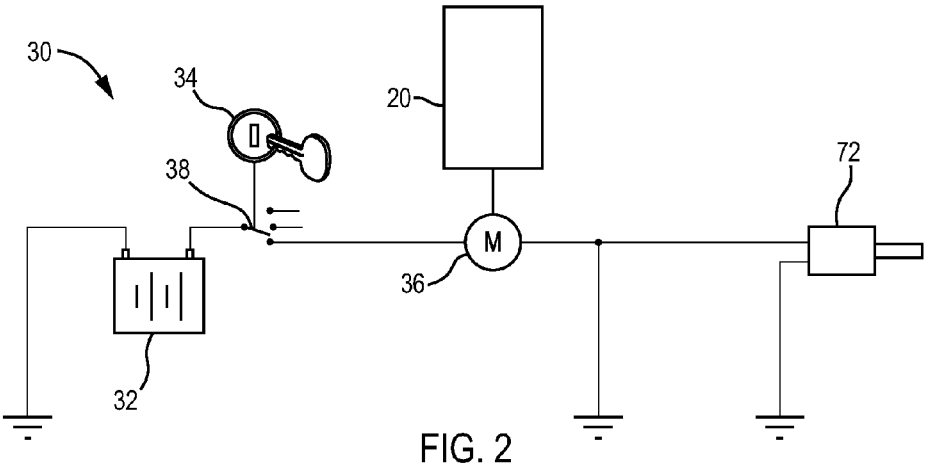
FIG. 2 is a schematic diagram of a starter system for an internal combustion engine.

As shown schematically in FIG. 2, the engine 20 is coupled to a starting system 30 with a battery 32, a starter motor 36 powered by the battery 32, a operator input such as an ignition actuator or keyswitch 34, and a starter switch or solenoid 38. The battery 32 provides stored electrical energy to operate the starting system 30 and may be configured to provide electrical energy to other systems of a vehicle powered by the engine 20. According to an exemplary embodiment, the battery is a 12-volt battery (e.g., a lead acid battery). In some embodiments, the keyswitch 34 has a stop position, a run position, and a start position. An operator starts the engine 20 by turning the keyswitch 34 to a start position. This, in turn, closes the starter solenoid 38 to electrically couple the starter motor 36 to the battery 32.

The starter motor 36 draws power from the battery 32 and is configured to turn the crankshaft of the engine 20 to start the engine 20. Once the engine 20 is running, the operator may turn the keyswitch 34 to the run position, opening the starter solenoid 38 to decouple the starter motor 36 from the battery 32. In some embodiments, the ignition actuator 34 is a pushbutton, switch, or other appropriate user input device.

Figure 3:
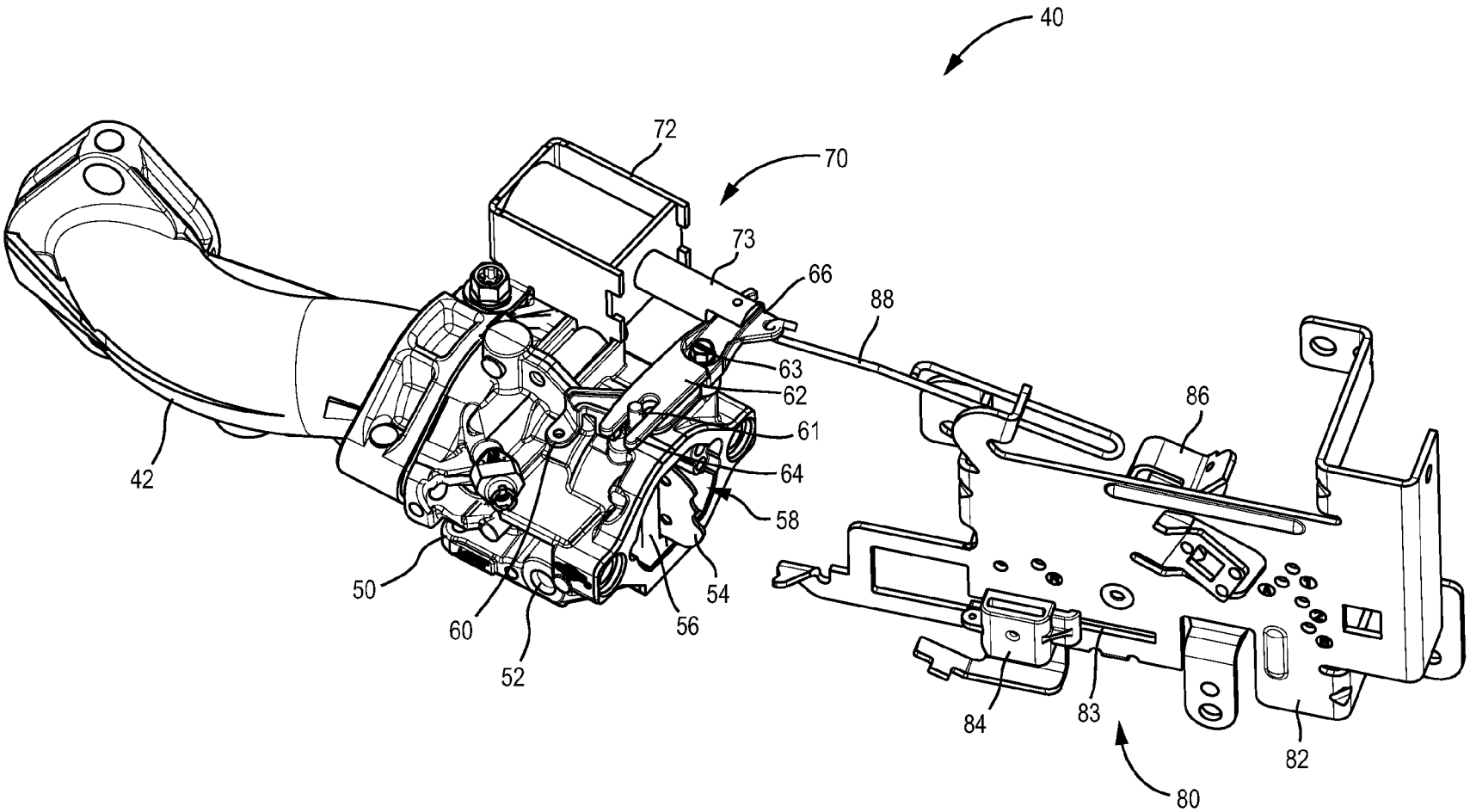
FIG. 3 is an isometric view of an air intake assembly for the internal combustion engine of FIG. 1.

Referring to FIG. 3, the engine 20 further includes an air intake assembly 40 with an intake manifold 42 coupled to a carburetor 50. The engine 20 draws an air/fuel mixture into the engine 20 via the air intake assembly 40. Air is directed to the air intake assembly 40 (e.g., through an air filter), where it is mixed with a fuel (e.g., gasoline) in the carburetor 50. The air/fuel mixture is then directed through the intake manifold 42 to the cylinder block 26, where it is combusted in an internal combustion chamber that may be formed from a cylinder and a piston, a plurality of pistons, a cylinder head, a valve, a plurality of valves and the like. According to an exemplary embodiment, the carburetor 50 is coupled to an automatic choke mechanism 70 and a manual choke mechanism 80. The automatic choke mechanism 70 and the manual choke mechanism 80 act to adjust carburetor 50 to provide a preferred air-to-fuel ratio in a variety of operational conditions.

The air flow rate through the air cleaner and the air intake assembly may be in part governed by a controller (not shown), such as a computer, with a processor, memory, and/or stored instructions. For example, the controller may activate a super- or turbo-charger compressor fan, based upon the stored instructions (e.g., a logic module), to draw an increased air flow through the air system. Such a controller may also operate other features and components of an engine, such as a timing of valves in a combustion chamber, and the like.

Figure 4:
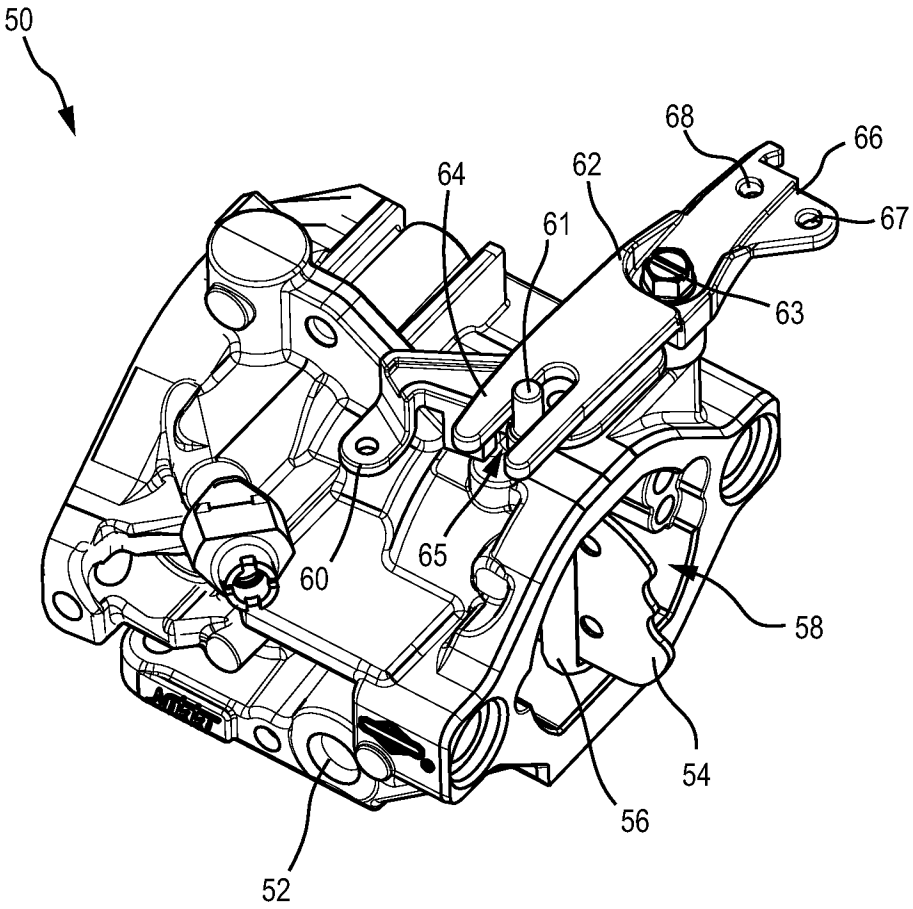
FIG. 4 is an isometric view of the carburetor for the air intake assembly of FIG. 3.

Referring to FIG. 4, the carburetor 50 mixes fuel from a fuel input 52 with air for combustion in the engine 20. The carburetor 50 includes a throttle valve with a throttle lever arm (not shown) and a choke valve 54 (e.g., choke plate). The choke valve 54 is a butterfly valve that rotates about a shaft 56 in an air inlet passage 58 to control the amount of air drawn into the carburetor 50 and the ratio of air to fuel mixed in the carburetor 50. In an open position, as shown in FIG. 4, the choke valve 54 is oriented generally parallel to the flow of air through the inlet passage 58, thereby increasing the air flow into the carburetor 50 to provide a leaner air/fuel mixture to the engine 20. In a closed position (as shown in FIGS. 6A-7B), the choke valve 54 is oriented generally perpendicular to the flow of air through the inlet passage 58, thereby reducing the air flow into the carburetor 50 to provide a richer air/fuel mixture to the engine 20. In an exemplary embodiment, the choke valve 54 is biased to the open position by a biasing member, such as a torsion spring (not shown).

Referring still to FIG. 4, the choke valve shaft 56 is coupled to a choke lever 60 mounted to the exterior of the carburetor 50. According to an exemplary embodiment, the choke lever 60 is coupled via a linkage 62 to the automatic choke mechanism 70 and the manual choke mechanism 80. The automatic choke mechanism 70 and the manual choke mechanism 80 adjust the carburetor 50 by acting on the choke lever 60 through the linkage 62 to adjust the position of the choke valve 54 in the inlet passage 58. The linkage 62 coupling the automatic choke mechanism 70 and the manual choke mechanism 80 to the choke lever 60 is formed by a single lever rotating about a pivot point 63. A first end 64 of the linkage 62 includes a slot 65 that engages a peg 61 (e.g., protrusion, nub, extension, etc.) of the choke lever 60. A second end 66 of the linkage 62 includes a first opening 67 by which the automatic choke mechanism 70 is coupled to the linkage 62 and a second opening 68 by which the manual choke mechanism 80 is coupled to the linkage 62. The single member linkage 62 simplifies the mechanical connection between the choke lever 60 and the choke mechanisms 70 and 80, reducing the potential for stacked tolerance issues and providing a more precise and responsive movement of the choke lever 60 in response to input from the automatic choke mechanism 70 or the manual choke mechanism 80.

Figure 5B:
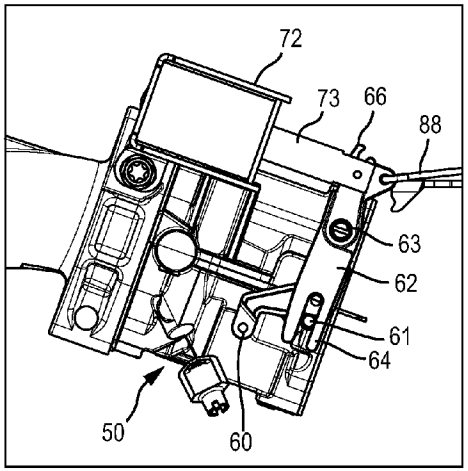
FIG. 5B is a top view of the air intake assembly of FIG. 3 with the choke open.
Figure 5A:
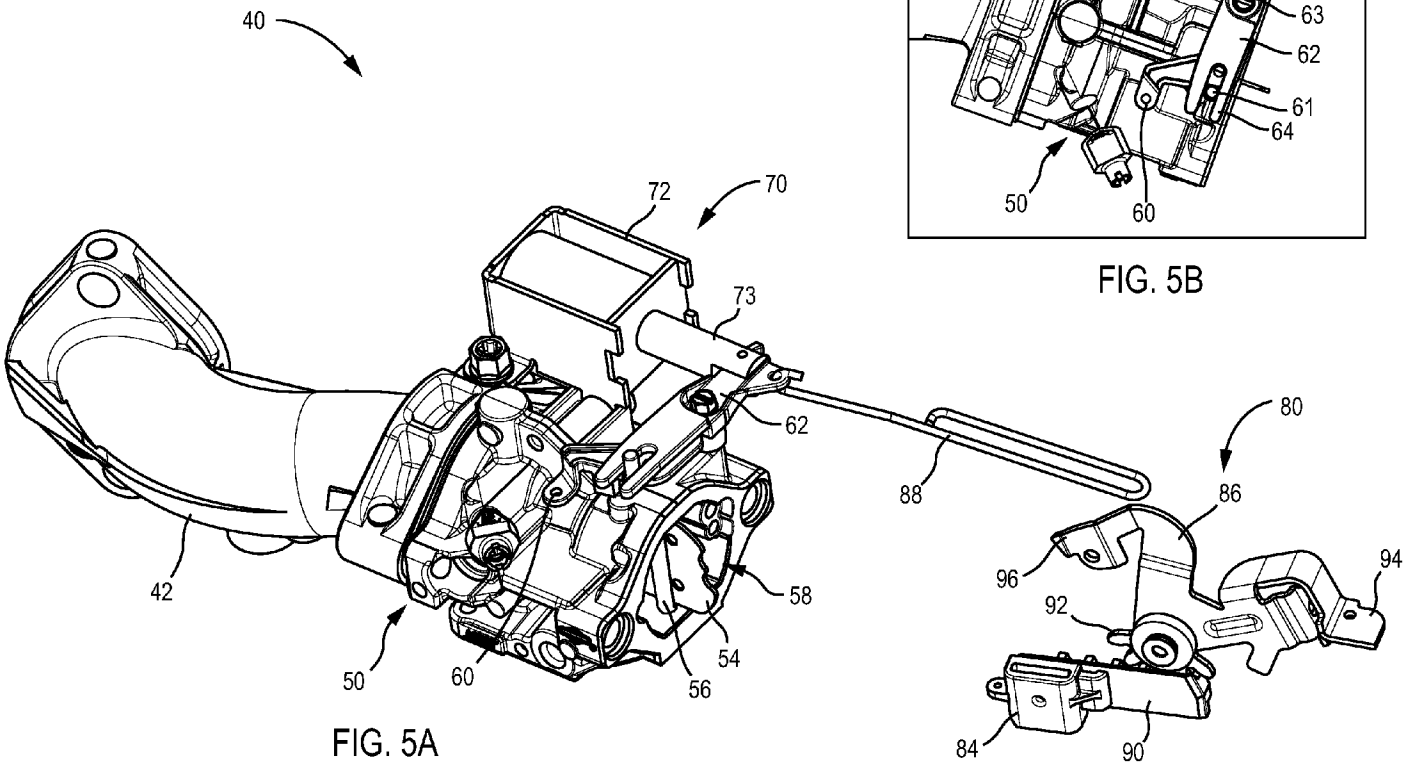
FIG. 5A is an isometric view of the air intake assembly of FIG. 3 with the choke open.

Referring now to FIGS. 5A-7B, the air intake assembly 40 is shown in several modes of operation. FIGS. 5A and 5B depict the air intake assembly 40 when the engine 20 is at rest with the choke valve 54 in the open position.

Figure 6B:
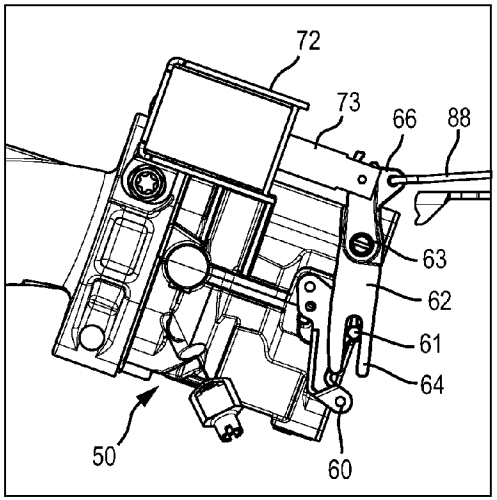
FIG. 6B is a top view of the air intake assembly of FIG. 3 with the choke closed by the automatic choke mechanism.
Figure 6A:
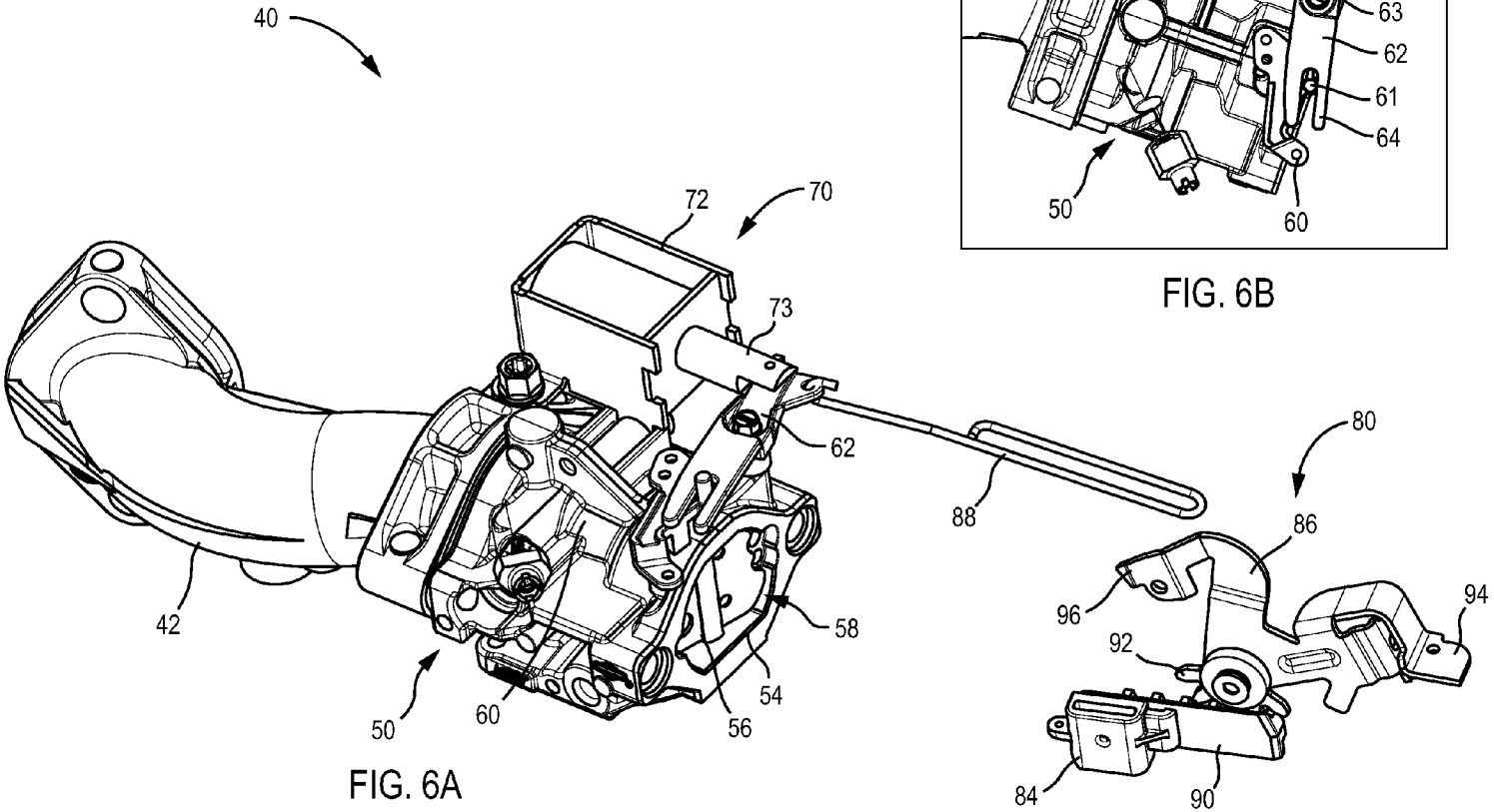
FIG. 6A is an isometric view of the air intake assembly of FIG. 3 with the choke closed by an automatic choke mechanism.

FIGS. 6A and 6B depict the air intake assembly 40 when the engine 20 is being started with the starting system 30. The automatic choke mechanism 70 is utilized to automatically engage the choke to enrich the air/fuel mixture and facilitate the starting of the engine 20 and disengage the choke at an appropriate point to keep the engine 20 from stumbling or stalling after it has started. In an exemplary embodiment, the automatic choke mechanism includes a solenoid 72 that is electrically coupled to the starting system 30 and mechanically coupled to the air intake assembly 40, for example, via a pinned connection to the first opening 67 of the linkage 62. In some embodiments, the solenoid 72 includes a plunger 73 (e.g., a linear actuator, a post, etc. biased to a normally extended position. In different embodiments, the shape of the plunger 73 may vary. In some embodiments, the solenoid 72 is a rotary solenoid. The solenoid 72 is attached to the carburetor 50 and, in some embodiments, may also be attached to the air intake manifold 42 proximate to the carburetor 50. This provides for a relatively small, compact assembly of the solenoid 72 and carburetor 50 which keeps the overall size of the engine 20 substantially the same as an engine without the automatic choke mechanism 70. This is advantageous because it reduces the design constraints or changes necessary to use the engine 20 with the automatic choke mechanism 70 in a commercial product (e.g., lawn mower, snow thrower, generator, pressure washer, etc.).

As shown in FIG. 2, the solenoid 72 is electrically coupled to the starting system 30 through the starter motor 36. The solenoid 72 is electrically coupled in series with the starter motor 36. In some embodiments, a thermal switch (e.g., thermal switch 74 shown in FIG. 8 and discussed below) is electrically coupled in series between the solenoid 72 and the starter motor 36. The thermal switch is configured to open when subjected to a threshold temperature, thereby breaking the circuit and cutting power to the solenoid 72. In some embodiments, the thermal switch is located on or near the engine block to detect the threshold engine temperature. The threshold engine temperature may be, for example, 110° F. By cutting power to the solenoid 72 at the threshold engine temperature, the thermal switch deactivates the automatic choke mechanism 70 when the engine 20 is already warm enough to not require automatic choking for a warm restart. The solenoid 72 may be coupled to the starter motor 36 with an existing wire harness and no additional inputs or wire harnesses are needed. When the operator starts the engine 20 by turning the keyswitch 34, the starter solenoid 38 closes to electrically couple the solenoid 72 to the battery 32 such that the battery 32 energizes the solenoid 72. When energized by the battery 32, the plunger 73 of the solenoid 72 moves from its extended, rest position to a retracted position. In some embodiments, the solenoid 72 activates at a voltage (e.g., approximately 5V) that is less than the voltage (e.g., an operational voltage) drawn by the starter motor 36 (e.g., approximately 7.5V). When the starter solenoid 38 closes, the solenoid 72 is therefore activated before the starter motor 36. The plunger 73 of the solenoid 72 is positioned along and travels in a direction parallel to the flow of air through the carburetor 50 (i.e., parallel to the longitudinal axis of the air inlet passage 58). In other embodiments, the plunger 73 does not travel in a direction parallel to the flow of air through the carburetor 50. Because the end of the plunger 73 is coupled to the first opening 67 in the linkage, the retraction of the plunger 73 rotates the linkage 62 about the pivot point 63. The rotation of the linkage 62 forces the peg 61 to move along the slot 65, causing the choke valve 54 to rotate in the air inlet passage 58 to the closed position. In the closed position, the choke valve 54 reduces the air flow into the carburetor 50 to provide a richer air/fuel mixture when the engine 20 is started.

Once the engine 20 has started and the operator moves the keyswitch 34 from the starting position to the run position, the starter motor 36 begins to ramp down. As the starter motor 36 runs down from full speed to a stop, a voltage continues to be applied to the solenoid 72. The automatic choke mechanism 70 therefore continue to hold the choke valve 54 in the closed position for a short period (e.g., approximately 0.4 seconds) after the engine 20 has started and the starter motor 36 is disengaged. This short period of time prolongs the amount of time the engine 20 is choked, which can be advantageous for some engines, particularly when starting the engine in cold weather. When the starter motor 36 stops turning and a voltage is no longer applied to the solenoid 72, the biasing member returns the choke valve 54 to the open position.

The voltage provided to the solenoid 72 by starting system 30 is limited by the capacity of the battery 32 and the voltage needed to turn the starter motor 36. The starting system 30 is configured to provide the solenoid 72 a voltage that is sufficient to actuate the solenoid 72 to overcome the biasing force urging the choke valve 54 to the open position. By orienting the plunger 73 of the solenoid 72 parallel to the flow of air through the carburetor 50 and coupling the post to the choke valve 54 with a single linkage or lever 62, allows the stroke of the plunger 73 to be minimized while delivering sufficient force to the linkage 62 to close the choke valve 54. The force delivered by the solenoid 72 is limited by two primary factors, the voltage applied to the solenoid 72, which is itself limited by the battery 32 and other draws on the battery 32, and the length of the stroke of the plunger 73. Using the mechanical advantage provided by the single linkage 62 allows the stroke of the plunger 73 to be optimized relative to the voltage available from the battery 32 to ensure that the solenoid 72 closes the choke valve 54 when the starting system 30 is activated.

Figure 8:
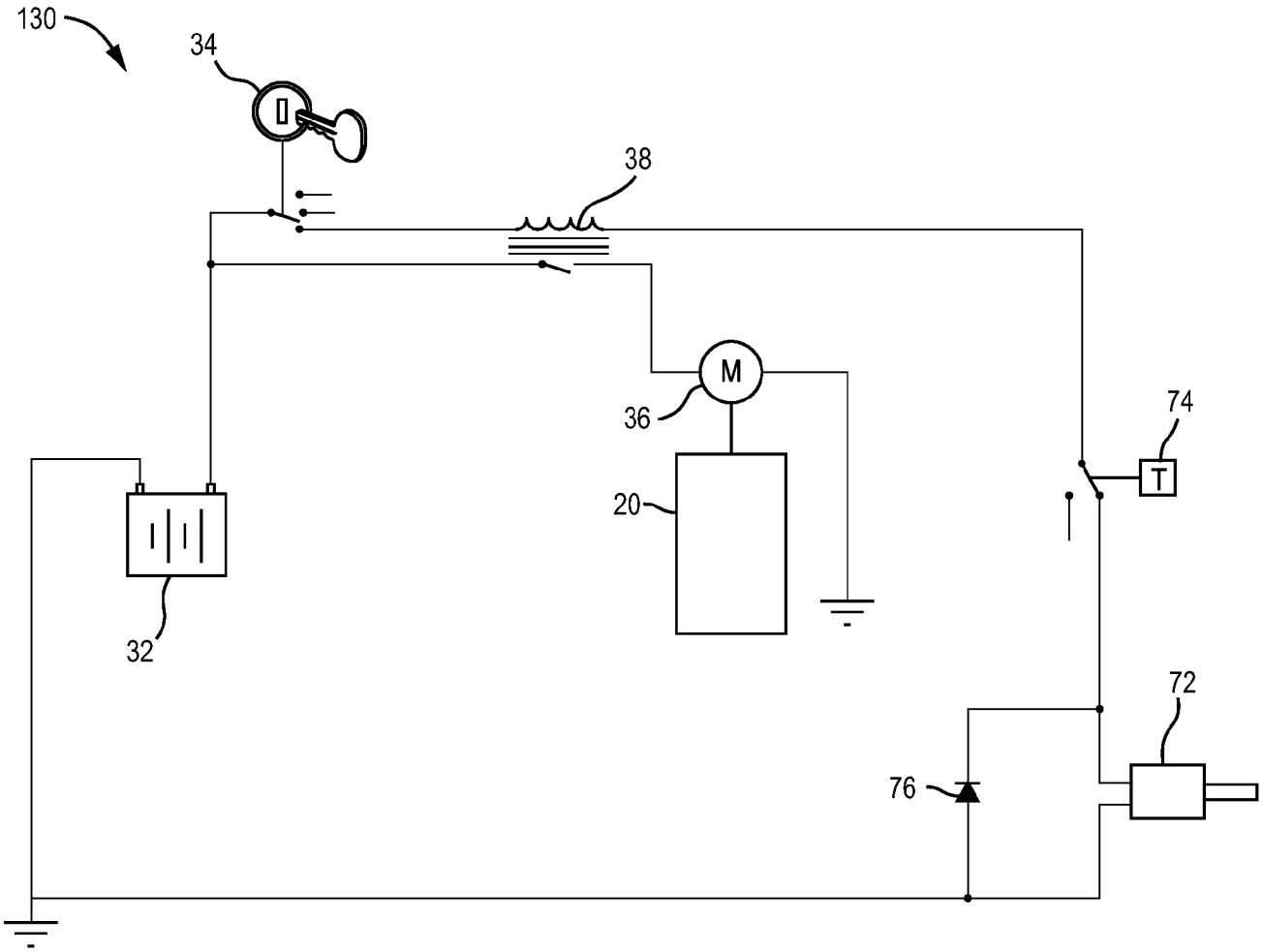
FIG. 8 is a schematic diagram of a starter system for an internal combustion engine, according to an exemplary embodiment.

Referring to FIG. 8, an alternative starting system 130 is illustrated. Except for the differences discussed below, the starting system 130 is similar to the starting system 30. In starting system 130, the solenoid 72 is electrically coupled in parallel with the starter motor 36. When the ignition actuator 34 is moved to the start position, the starter solenoid 38 is energized. The high voltage side of the starter solenoid 38 conducts power to the starter motor 36 to start the starter motor 36. The low voltage side of the starter solenoid 38 is electrically coupled to the solenoid 72 of the autochoke mechanism 70 so that the solenoid 72 is energized when the starter solenoid 38 is energized. Thermal switch 74 is electrically coupled in series between the starter solenoid 38 and the solenoid 72 and configured to break the circuit and cut power to the solenoid 72 when exposed to a threshold engine temperature. Diode 76 is electrically coupled in parallel with the solenoid 72. Diode 76 prevents remanence or the magnetization of the housing or other components of the solenoid 72 that may occur due to repeated cycling of the solenoid 72. In some embodiments, the diode 76 is incorporated into the wiring harness coupled to the solenoid 72. When the ignition actuator 34 is moved out of the start position (e.g., to the run position), the starter solenoid 38 is de-energized and the solenoid 72 is de-energized. In this way, the solenoid 72 of starting system 130 is de-energized in response to the ignition actuator, not the in response to the starter motor 36 like the solenoid 72 of starting system 30. Accordingly, starting system 130 does not provide the extra "short period" of choke provide by starting system 30. This can be advantageous for engines that are particularly sensitive to choke.

The location of the pivot point 63 closer to the second end 66 than to the first end 64 and the sliding connection between the peg 61 of the choke lever 60 and slot 65 of the linkage 62 provides a mechanical advantage. The stroke length of the plunger 73 of the solenoid 72 may therefore be minimized while still rotating the choke lever 60 a sufficient amount to move the choke valve 54 from the open position to the closed position. A minimal stroke length for the plunger 73 increases the amount of force that may be applied to the linkage 62 by the solenoid 72. In an exemplary embodiment, the stroke length of the plunger 73 is between 5 mm and 8 mm. In a preferred embodiment, the stroke length of the plunger 73 is between 6.2 mm and 6.3 mm. In other embodiments, the plunger 73 may have a stroke length of less than 5 mm or more than 8 mm.

Figure 7B:
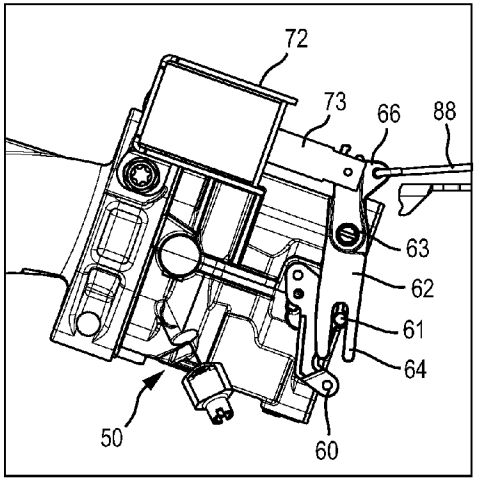
FIG. 7B is a top view of the air intake assembly of FIG. 3 with the choke closed by the manual choke mechanism.
Figure 7A:
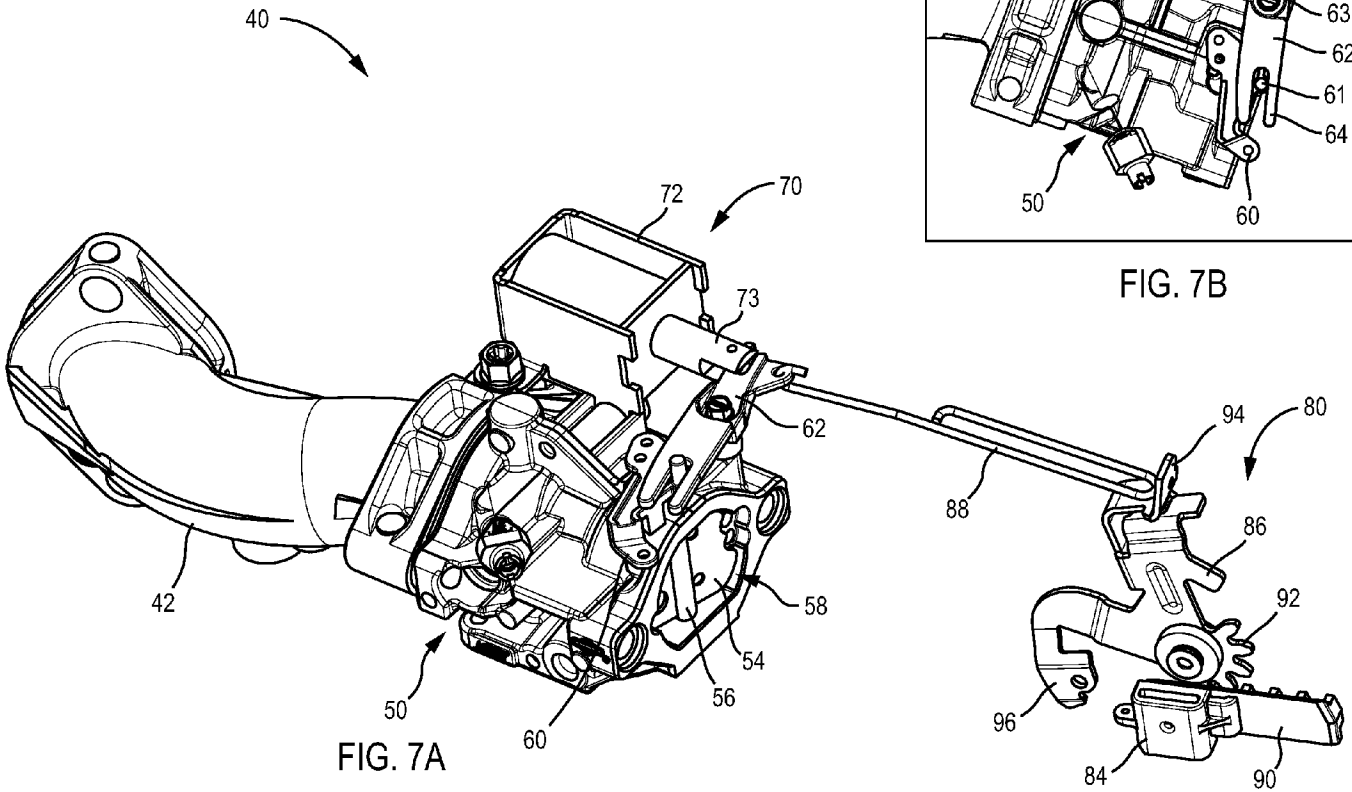
FIG. 7A is an isometric view of the air intake assembly of FIG. 3 with the choke closed by a manual choke mechanism.

FIGS. 7A and 7B depict the air intake assembly 40 with the manual choke mechanism 80 utilized to close the choke valve 54 independently of the starting system 30. In some scenarios (e.g., in cold operating environments below approximately 40° F.), the automatic choke mechanism 70 may disengage too quickly, causing the air/fuel mixture to lean out prematurely and making it difficult to start the engine 20. The manual choke mechanism 80 allows an operator to adjust the position of the choke valve 54 to obtain a desired fuel/air mixture. The manual choke mechanism 80 is mounted to a bracket 82 (as shown in FIG. 3) coupled to the engine 20 and includes a button or slide 84, a first link or member 86, and a second link or member 88.

The slide 84 may be moved along a slot or track 83 in the bracket (as shown in FIG. 3) by an operator. The slide 84 is fixed to a rack gear 90 that engages a pinion gear 92 on the first link 86. Movement of the slide 84 along the track 83 rotates the first link 86 through the rack and pinion interface, bringing a tab or contact 94 on the first link 86 into contact with an end of the second link 88. Further movement of the slide 84 along the track 83 causes further rotation of the first link 86, which pushes against the second link 88, as shown in FIG. 7A. A manual input device (e.g., a lever, handle, etc.) is coupled to the manual choke mechanism 80 (e.g., by a Bowden cable) to provide a means for the user or operator to actuate or move the manual choke mechanism 80 (e.g., by moving the slide 84). According to an exemplary embodiment, the second link 88 is a bent wire member. Because the end of the second link 88 is coupled to the second opening 68 in the linkage 62 (e.g., by a hooked end of the second link 88), the movement of the second link 88 rotates the linkage 62 about the pivot point 63. The rotation of the linkage 62, in turn, moves the choke valve 54 within the air inlet passage 58 as described above in relation to the automatic choke mechanism 70. The operator may therefore move the choke valve 54 to any position between a fully open position and a fully closed position utilizing the manual choke mechanism 80 to achieve a desired air/fuel mixture.

The manual choke mechanism 80 may be biased towards the default position shown in FIGS. 3, 5A, and 6A by a member such as a spring (e.g., compression spring, tension spring, torsion spring, etc.) or another biasing device coupled to a component of the manual choke mechanism 80. According to an exemplary embodiment, the manual choke mechanism 80 includes a tension spring (not shown) coupled between an arm 96 of the first link 86 and the bracket 82. By biasing the manual choke mechanism 80 towards the default position, the second link 88 is automatically disengaged from the first link 86 unless the operator is utilizing the manual choke mechanism 80 and applying a force to the slide 84 to overcome the biasing force. The disengagement of the first link 86 from the second link 88 allows the linkage 62 and the second link 88 to move independently without moving the rest of the manual choke mechanism 80 (e.g., when the linkage 62 is moved by the automatic choke mechanism 70).

The construction and arrangements of the choke mechanism, as shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. Other substitutions, modifications, changes and omissions may also be made in the design, operating conditions and arrangement of the various exemplary embodiments without departing from the scope of the present invention.

What is claimed is:

1. A choke system for an internal combustion engine, comprising:

a carburetor having an air intake, a choke valve disposed in the air intake, and a choke lever coupled to the choke valve, wherein the choke valve is movable between a closed position and an open position;

a mechanical linkage coupled to the choke lever; and a solenoid attached to the carburetor and coupled to the mechanical linkage so activation of the solenoid moves the choke valve, wherein the solenoid is activated in response to activation of a starter system of an internal combustion engine, thereby moving the choke valve via the mechanical linkage to the closed position;

wherein the mechanical linkage comprises a single lever having a first end coupled to the choke lever and a second end coupled to the solenoid, and the mechanical linkage is rotatable about a pivot point between the first end and the second end;

wherein the solenoid is configured to be energized at a voltage lower than an operational voltage of a starter motor of the internal combustion engine.

2. The choke system of claim 1, wherein the solenoid includes a plunger, wherein movement of the plunger causes movement of the choke valve, wherein the plunger is movable between an extended position and a retracted position, wherein the plunger moves in a direction parallel to a flow of air through the air intake, and wherein the plunger moves from the extended position to the retracted position in response to activation of the starter system of the internal combustion engine, thereby moving the choke valve via the mechanical linkage to the closed position.

3. The choke system of claim 1, wherein the pivot point is disposed closer to the second end than to the first end.

4. The choke system of claim 1, further comprising:

a manual choke mechanism configured to be coupled to a manual input device so that the choke valve is moved to the closed position in response to movement of the manual input device.

5. The choke system of claim 4, wherein the manual choke mechanism comprises a first member and a second member, the first member configured to move in response to movement of the manual input device and the second member coupled to the mechanical linkage and selectively coupled to the first member so that movement of the manual input device is transferred to the mechanical linkage via the first member and second member to move the choke valve to the closed position.

6. The choke system of claim 5, wherein the first member is biased to a position in which the first member is decoupled from the second member.

7. An engine starting system, comprising:

a battery;

a starter motor electrically coupled to the battery;

a starter switch electrically coupled between the battery and the starter motor;

an ignition actuator configured to close the starter switch when the ignition actuator is in a start position;

a carburetor having an air intake and a choke valve disposed in the air intake; and an automatic choke mechanism coupled to the choke valve, the automatic choke mechanism comprising a solenoid electrically coupled to the starter switch and mechanically coupled to the choke valve;

wherein the solenoid includes a plunger moveable in a direction parallel to a flow of air through the air intake between an extended position and a retracted position;

wherein the solenoid is configured to be energized at a voltage lower than an operational voltage of the starter motor; and wherein the plunger moves to the retracted position to close the choke valve when the starter switch is closed and moves to the extended position to open the choke valve when the starter switch is open.

8. The engine starting system of claim 7, further comprising:

a thermal switch electrically coupled in series with the starter switch and the solenoid, the thermal switch configured to open in response to a threshold engine temperature, thereby cutting power to the solenoid.

9. The engine starting system of claim 8, further comprising:

a diode electrically coupled in parallel around the solenoid and electrically coupled to ground, the diode configured to reduce remanence in the solenoid due to repeated cycling of the solenoid.

10. The engine starting system of claim 7, further comprising:

a diode electrically coupled in parallel around the solenoid and electrically coupled to ground, the diode configured to reduce remanence in the solenoid due to repeated cycling of the solenoid.

11. The engine starting system of claim 7, further comprising:

a choke lever coupled to the choke valve;

a mechanical linkage mechanically coupling the solenoid to the choke valve, the mechanical linkage comprising a single lever having a first end coupled to the choke lever and a second end, and the linkage is rotatable about a pivot point between the first end and the second end.

12. The engine starting system of claim 11, wherein the second end of the mechanical linkage is coupled to the automatic choke mechanism.

13. The engine starting system of claim 12, further comprising:

a manual choke mechanism coupled to the second end of the mechanical linkage and configured to be coupled to a manual input device so that the choke valve is closed in response to movement of the manual input device.

14. The engine starting system of claim 13, wherein the manual choke mechanism comprises a first member and a second member, the first member configured to move in response to movement of the manual input device and the second member coupled to the mechanical linkage and selectively coupled to the first member so that movement of the manual input device is transferred to the mechanical linkage via the first member and second member to close the choke valve.

15. The engine starting system of claim 14, wherein the first member is biased to a position in which the first member is decoupled from the second member.

16. A method for adjusting the position of a choke valve, comprising:

providing a choke valve in the air passage of a carburetor;

providing a linkage external to the carburetor and coupled to the choke valve;

providing an automatic choke mechanism electrically coupled to a starting system for an engine, the automatic choke mechanism comprising a solenoid coupled to the linkage and oriented parallel to the air passage, and the starting system comprising a starter motor electrically coupled to the solenoid; and energizing the solenoid at a voltage lower than an operational voltage of the starter motor upon activation of the starting system, thereby rotating the linkage and closing the choke valve.

17. The method of claim 16, wherein the starting system further comprises a battery and a starter switch, with the starter motor electrically coupled to the battery, the starter switch electrically coupled between the battery and the starter motor, and the solenoid electrically coupled to the starter switch, and further comprising;

energizing the solenoid when the starter switch is closed.

18. The method of claim 16, further comprising:

providing a manual choke mechanism, the manual choke mechanism comprising a first member and a second member coupled to the linkage;

moving the first member to engage the second member, thereby rotating the linkage with the second member to adjust the choke valve.

* * * * *